United States Patent [19]

Roseby et al.

[11] 4,174,684

[45] Nov. 20, 1979

[54] VARIABLE STROKE INTERNAL COMBUSTION ENGINE

[76] Inventors: Bernard Roseby, 150 W. Edith Ave., #43; Eckhard P. Hallmann, 2230 Ancora Ct., both of Los Altos, Calif. 94022

[21] Appl. No.: 799,660

[22] Filed: May 23, 1977

[51] Int. Cl.[2] ..... F02B 75/04; F02B 75/26

[52] U.S. Cl. ..... 123/48 B; 123/58 BA; 123/58 BC

[58] Field of Search ..... 123/48 R, 48 A, 48 AA, 123/48 B, 48 C, 58 B, 58 BA, 58 BB, 58 BC, 78 R, 78 A, 78 AA, 78 E, 78 F, 197 R, 197 A, 197 AB, 197 AC

[56] References Cited

U.S. PATENT DOCUMENTS

| | | | |
|---|---|---|---|
| 1,042,018 | 10/1912 | Macomber | 123/48 B |
| 1,937,077 | 11/1933 | West | 123/58 BA |
| 2,465,638 | 3/1949 | Eckert | 123/197 R |
| 2,551,025 | 5/1951 | Lindeman | 123/58 BA |

*Primary Examiner*—Charles J. Myhre
*Assistant Examiner*—Craig R. Feinberg

[57] ABSTRACT

An internal combustion engine in which the longitudinal center line of the cylinders are parallel to and equally spaced around the longitudinal center line of the engine.

The pistons, working within said cylinders, are mounted on a swash plate mechanism, by means of which the reciprocating motion of the pistons is translated into the rotary motion of a carrier plate to which the said swash plate is mounted and, from which, is taken the drive into the vehicle transmission.

Said swash plate is mounted on a post at the circumference of the carrier plate and pivots around said post when moved, on a longitudinal axis, by a mechanism.

As each piston, in turn, passes the point on the swash-plate adjacent to the mounting post, it is at the top-dead-center position in its cylinder. As said piston passes the diametrically opposite point on the swash plate it is at the bottom-dead-center position.

When the swash plate angle is changed, by moving said mechanism, the bottom dead center position is changed thus causing the stroke of the piston to be changed.

A circular form cylinder head contains a combustion chamber for each cylinder and a disc, driven by a forward projecting shaft mounted on the carrier plate, through gearing, and having cam forms on the face actuates the valve mechanism to cause the inlet and exhaust gases to flow to and from the cylinders as required for operation of the running cycle.

4 Claims, 14 Drawing Figures

FIG. 4A
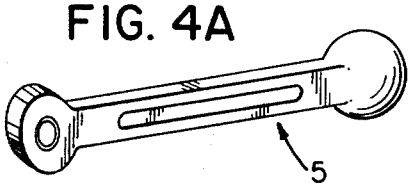
FIG. 4B
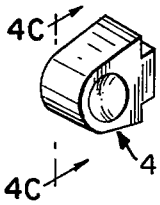
FIG. 4C
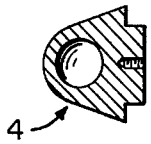
FIG. 4D
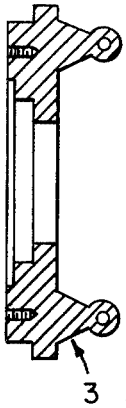
FIG. 4E
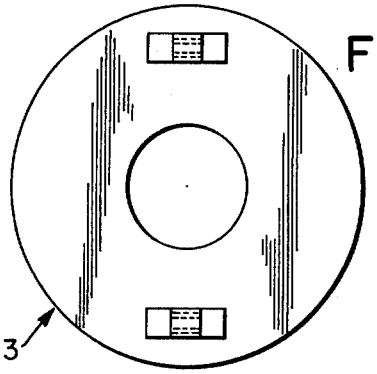
FIG. 4F
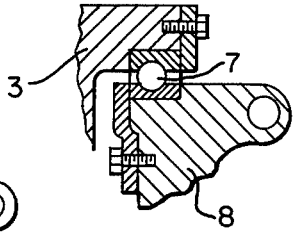
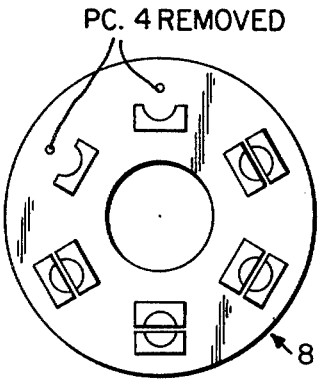
FIG. 4G
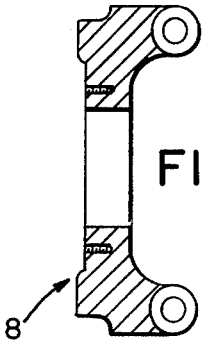
FIG. 4H
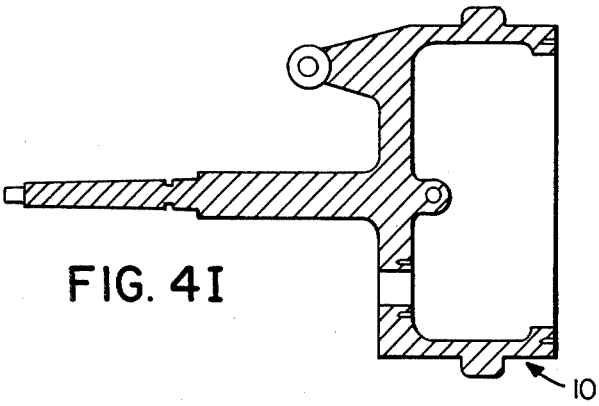
FIG. 4I
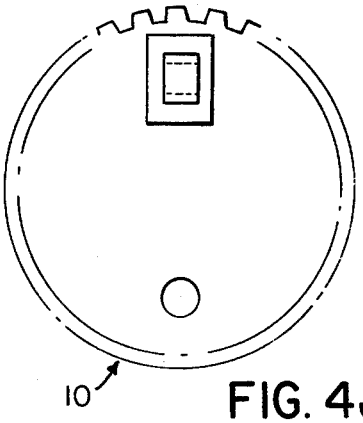
FIG. 4J

VARIABLE STROKE INTERNAL COMBUSTION ENGINE

BACKGROUND TO THE INVENTION

One of the most promising solutions to the problems of achieving improved mileage-to-the-gallon of gasoline on the internal combustion powered road vehicle is the use of the variable stroke engine.

This allows the effective swept volume of the engine to be varied to meet the driving requirements of the moment so that full stroke, and thereby full piston displacement, is available for such full power needs as acceleration, climbing and high speed running conditions and permits shorter stroke, lesser piston displacements to be used for cruising, idling or start-up conditions. A secondary, but equally important advantage is the reduction of the compression ratio as the stroke is shortened, thus reducing pumping pressures during the compression and exhaust strokes of a four cycle engine and during start-up operations, thereby minimizing loads on the engine starter motor and on the storage battery, permitting these components to be reduced in size and weight as well as in cost. Other benefits include reduced piston speeds, with a consequent reduction in wear and lower exhaust emission mass flow resulting from the lower induced mass flow in the shorter stroke mode.

The methods of producing such a variable stroke engine, at present under consideration and development are, in fact, modifications to the existing concept of the crankshaft engine and consist of such approaches as the interposition of a secondary linkage between the crankshaft and the piston rod adjusted by means of screws, and the use of variable height pistons, all of which have the effect of varying the stroke without changing the swing diameter of the crankpin. As a result there occurs a diminution of mechanical efficiency resulting in the absorption of kinetic energy in the driving of a mechanical system designed for a basic function different to that which is being applied, in addition there is an increase in complexity, weight and cost of the engine.

This invention is based on the philosophy that, in order to achieve efficient, economical stroke variation a totally new configuration of engine is necessary, without the constraints of working within the bounds of existing engine concepts.

For this reason the "wobble plate" design was selected as a base from which to develop the invention, in which the cylinders are oriented around, and parallel to, the engine longitudinal center line, with the pistons acting against a wobble plate supported by a thrust bearing against a swash plate inclined so as to cause the wobble plate to oscillate in response to piston movement, said thrust bearing being also attached to said swash plate and, in which, the oscillating motion of the wobble plate is translated into rotary motion by means of the reaction of said thrust bearing against said swash plate, which is carried on the face of a carrier plate.

The angle of this swash plate can be varied by operator command without causing the carrier plate to move out of its plane of rotation, which is at right angles to the longitudinal center line of the engine. Thus, by varying the angle of inclination of the swash plate and, consequently, the wobble plate, the stroke of the pistons is caused to be changed.

The design is so arranged, as shown in the drawings, as to change the stroke of the pistons by moving the "bottom dead center" equivalent position of the pistons towards the cylinder head, thus retaining a constant combustion chamber volume throughout all variations of stroke and compression ratio.

The optional use of the opposing face of the variable angle of inclination swash plate to provide, if required, the pumping element for the fluid output section of a hydrostatic type of transmission as shown in FIG. 2. (Sheet 2) offers further versatility to this approach, while a mechanical transmission output can be used as shown in FIG. 1 (Sheet 1).

The total volume of space occupied by, and the weight of this engine is considerably less than that of a similar maximum swept volume crankshaft engine as is the magnitude of inertial losses due to the drive of unnecessary mechanisms in other variable stroke engine concepts.

It is anticipated that this invention will provide very considerable fuel savings in the operation of vehicles, which is an advantage that is particularly relevant in view of the necessity to reduce energy usage, is simpler in construction and will further result in a reduction of engine wear due to the lower piston speeds and bearing surface rubbing speeds at the short stroke condition which will probably be, by reason of normal driving patterns, be in operation for a majority of running time.

It is further believed to reach these goals in a simpler and more efficient form than other, previously mentioned, current endeavors in this field, or other variations to conventional engines such as the cutting out of some of the multiple cylinders of a normal crankshaft engine.

SUMMARY OF THE INVENTION

The invention relates to an internal combustion engine in which the cylinders (9) are located axially around the longitudinal center line, and parallel to and equidistant from the axial center line of said engine.

The invention is further described in connection with the accompanying drawings in which.

Figure 3A:
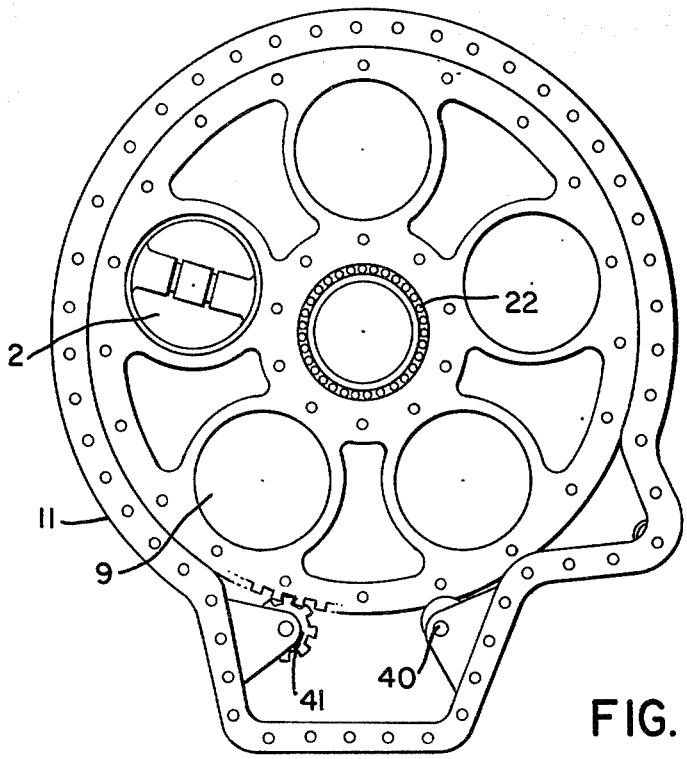
Figure 3B:
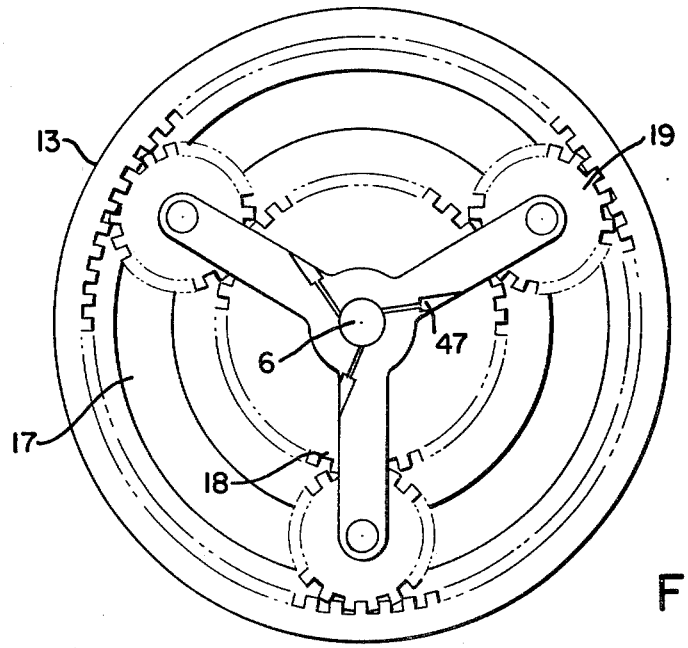

FIGS. 3A and B (Sheet 3) show cross sections indicating the typical orientation of the cylinders and the valve gear drive, respectively.

FIGS. 4A–J (Sheet 4) show some typical miscellaneous details of the piston rods, the split spherical bushings, the swash plate, the wobble plate and the carrier plate with its extension shaft, respectively.

Pistons (2) of conventional design, travel within said cylinders and are connected to piston rods (5) by a conventional gudgeon pin arrangement. The opposing ends of said piston rods are of spherical form, said spherical elements being retained between a pair of lugs, one lug of each pair being formed integrally on the face of a wobble plate (3) the other lug of each pair (4) being attached to said wobble plate by means of a screwed fastener and detachable from said wobble plate to facilitate installation of said piston rods within said spherical cavity formed between the pair of lugs, said lugs having a relief formed on the edges to permit oscillating motion of said piston rods to take place while said spherical element is engaged between said lugs, and said lugs are provided with an anti-friction lining of some material such as babbitt metal to permit such oscillating motion to occur freely and smoothly. Said lugs are disposed around the periphery of said wobble plate face, equally spaced and in allignment with the axial center lines of said cylinders when said wobble plate face is perpendicular to the axial center line of said engine. The split lines between said detachable and said integally formed lugs lie along the radii of said wobble plate face.

Hereinafter, that end of said engine that is towards the crowns of said pistons will be referred to as the forward end and the opposite end as the rearward end.

The forward end of said cylinder block (1) which contains said cylinders (9) is provided with studs on to which is secured a cylinder head (13) said cylinder head being of "donut" or annular form, with a central opening which aligns with a similar central opening passing through the entire length of said cylinder block. Said cylinder head has, within its rear face, being that face which is attached and mating with said cylinder block, spaces for compressing and igniting the fuel/air mixture which forms the motive power for said engine, and fittings for the inlet valves (15) and exhaust valve (14) of conventional design, threaded orifices for the installation of spark plug (42) ported and flanged connections for the attachment of manifolds (44) through which the fuel/air mixture and exhaust gases pass, said inlet mixture passing through filter (65), coolant passages and valve actuating gear support members (46) to which said valve actuating gear is mounted.

Within said opening passing through the center line of said cylinder block, are formed platform recesses for the mounting of bearings (22 and 23) and said cylinder block has, at its rear end, a mounting flange to which a casing (56 or 11) may be attached by means of bolts.

Said wobble plate (3) is so formed as to have, at its center, a large opening, said opening formed to receive a thrust bearing (7) said thrust bearing being retained in place by a retaining ring.

Said thrust bearing (7) is further mounted, by its other casing element, to a swash plate (8) in such a manner as to cause said swash plate to revolve in order to permit oscillatory motion of said wobble plate.

Said swash plate (8) is mounted on a single pivot point, said pivot point being mounted on an integral, projecting member of the carrier plate (10) in such a manner that the portion of said wobble plate that is located in a coincidental plane with said pivot point, such portion of said wobble plate carrying one of said pairs of piston rod mounting lugs (4), causes said piston (2) attached to said pair of lugs to be at the forward end of said cylinder, equivalent to the "top dead center" position of a conventional crankshaft type of engine.

Said carrier plate (10) has, mounted on the center of its forward face, a projecting shaft (6) extending forward and passing through the center axis of said cylinder block (1) and supported by a thrust bearing (22) to restrain rearwards thrust and, at the forward end of said cylinder block, by a radial bearing (23). Said shaft terminates at a point whereon is mounted a gear mechanism of epicyclic or some other form (18 and 19) through which is driven, at an appropriate reduction ratio, a cam disc (17) said cam disc having cam lobes so formed on its rearward face as to sequentially cause inlet valves (15) and exhaust valves (14) to open and close by means of said cam lobes reacting against pivoted rollers (16) said rollers being eccentrically mounted in yokes (29) and secured in such a manner as to permit suitable clearance between said rollers and the stems of said valves to be adjusted as necessary for the satisfactory operation of said valves, said rollers reacting against said valve stems through a pivotal mounting mechanism in response to the action of said cam lobes passing across said rollers.

The system operates in a cycle common to conventional four stroke cycle internal combustion engines, or to two stroke cycle internal combustion engines as required, wherein, in the former case, the spark plugs are energized and caused to sequentially ignite the fuel/air mixture within the combustion space by means of a power distribution mechanism (21) operated in this engine by the extension of that part of the valve drive mechanism that rotates at an appropriate reduction of engine speed, normally one half of engine speed.

Said swash plate (8) is further supported at a point diametrically opposed to said pivot point projection on said carrier plate by a sliding bar (26) passing through a guide bushing mounted within a spherical bearing to permit such oscillatory motion as is required, said spherical bearing (51) being mounted in the front face of said carrier plate (10) in such a manner that rotation of said swash plate (8), by transferring its rotary motion through said two suspension points on said carrier plate will carry said carrier plate around with said swash plate in a rotary plane perpendicular to the axial center line of said engine.

A crank arm (27) pivoted against a fulcrum integral with said carrier plate is so attached, in a sliding manner, to said sliding bar (26) that when the crank arm (27) is actuated by a link (28) it is caused to be moved axially. Said link (28) is attached either to a piston rod of a high pressure hydraulic piston (35) or to a coarse pitch screw (64), or some other actuating means, in such a manner that moving of the said hydraulic piston by the introduction behind said piston of high pressure hydraulic fluid from some external, conventional power source, or by the rotation of said coarse screw, or by spring and swash plate pressure action in the opposite direction, causes a reciprocating action of said sliding bar (26) to occur, thus causing said swash plate to rotate around said pivot point projection, thereby causing said swash plate to be moved to a different angle of inclination. Such a change in the angle of inclination of said swash plate (8) reacts against said wobble plate (3) through the thrust bearing (7) interposed between said swash plate and said wobble plate causing the non-fixed swivel point of said swash plate to move said wobble plate into a shallower angle of inclination when said sliding bar (26) is moved in a forward direction, and into a steeper angle of inclination when said sliding bar is moved in a rearward direction, thus changing the distance between the extreme points of inclination thereby increasing or reducing the effective stroke of said pistons and thereby achieving the variation in piston stroke of the engine.

As the four stroke cycle of induction, compression, power and exhaust strokes occur said wobble plate (3) is caused to oscillate as said pistons (2) pass through sequential strokes and, through the action of said thrust bearing (7) said swash plate is caused to rotate to permit said oscillation, carrying with it in its rotating plane said carrier plate (10) and said projecting shaft (6) said projecting shaft thereby driving said valve gear, cam disc and distributor rotor mechanisms.

A gear take off from the forward end of said shaft (6) drives a secondary shaft (47) said secondary shaft passing through a bushing (53) mounted in a valve gear cover (20) and carrying a vee belt pulley (54) or similar mechanism to drive a coolant fan and, in the case of a liquid cooled configuration, a coolant liquid circulating pump.

Said carrier plate (10) is supported, at the rear end, by a bearing (30) and has, integral with it, and around its periphery, a gear ring, said gear ring providing the means to drive auxilliary mechanisms including, but not limited to, a lubricating oil pump (41) which draws lubricating oil through a filter (52) and passes said oil through a circulation system to provide lubrication for the mechanisms operating within said engine, cylinder walls, bearings and other parts requiring such lubricating, a hydraulic fluid pump to provide high pressure hydraulic fluid to be used to actuate said hydraulic piston (35) when said hydraulic piston is used to actuate said swash plate angle change link (28). Said carrier plate gear ring also may accept drive from an electric engine starter motor (40) during the engine starting cycle.

Figure 1:
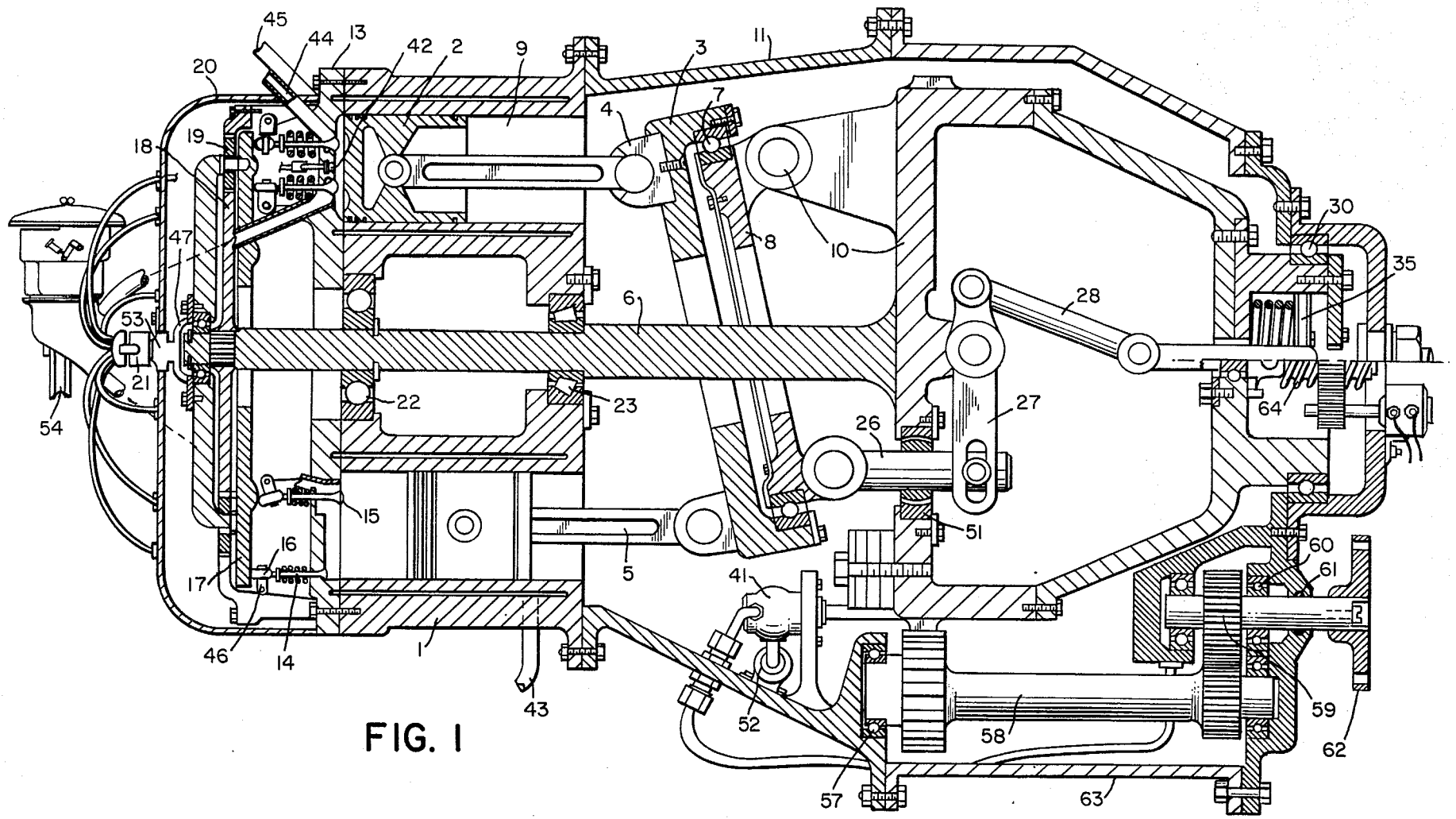
FIG. 1 (Sheet 1) is a cross section of the engine showing a typical mechanical transmission arrangement.
Figure 2:
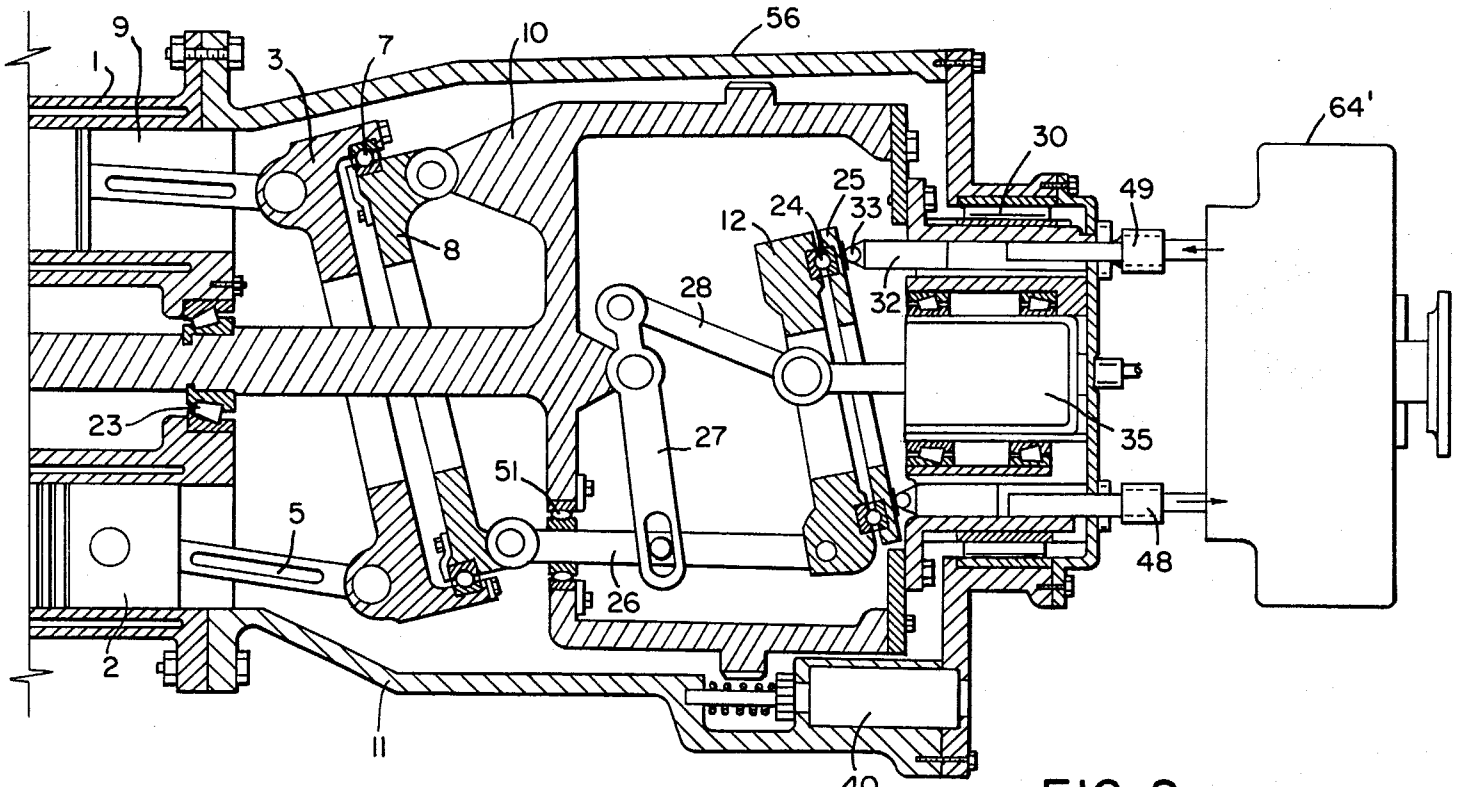
FIG. 2 (Sheet 2) is a cross section of the engine showing a typical "hydrostatic" transmission arrangement.

The output drive and the vehicle transmission may be one of two configurations:

A typical mechanical output drive is shown in FIG. 1 (Sheet 1) wherein the peripheral gear ring on said carrier plate (10) meshes in engagement with a gear formed integrally on a shaft (58) said shaft having a second gear at the rear end and is supported in bearings (57). Said gear at the rear end of said shaft meshes into engagement with a secondary gear (59) said gears and shafts being supported in bearings (60) and having secured to the rear end a mounting flange (62) to which may be secured on output shaft. Said secondary gear (59) shaft may be fitted with an oil seal (61) to retain lubrication oil within the engine casing (63), or said output may be derived from some other arrangement of gears or mechanisms by means of which the rotary motion of said carrier plate (10) is transferred to a vehicle transmission system. The second optional output drive arrangement is a typical hydrostatic transmission as shown in FIG. 2 (Sheet 2), wherein the rear face of a second variable angle swash plate (12), the angle of inclination of which is changed by a linkage connected to the rear end of said engine swash plate link (26) reacting through a thrust bearing (24) against a non-rotating wobble plate (25) said non-rotating plate being the drive member, acting against thrust pads (33) to move pistons (32) axially within cylinders in such a manner as to cause hydraulic fluid to be pumped from an outlet port (48) to a conventional hydraulic motor (64'), said hydraulic motor being of either variable or fixed input volume per revolution design, said hydraulic motor converting said flow of hydraulic fluid into rotary motion to be used as a drive element of a vehicle, and then returning said hydraulic fluid to said hydraulic piston pump through a return port (49).

Liquid cooling of said engine may be provided by means of coolant passages within said cylinder block (1) and said cylinder head (13) and circulated through a conventional coolant radiator or other form of heat exchanger (not shown) through a system of inlet and outlet pipes (43 and 45) to pass the coolant liquid through said coolant pump and radiator and thence back to said engine cylinder block.

Air cooling by means of suitable fin arrangements on the outer surfaces of said cylinders and cylinder head may be used in place of liquid cooling.

Should a two cycle engine configuration be selected, the projecting shaft (6) is retained to actuate the ignition distributor (21) and fan drive pulley (54) but the valve gear is eliminated in place of fuel/air/oil mixture transfer ports (not shown) of conventional design as used in two cycle engines.

We claim:

1. A variable stroke internal combustion engine in which multiple cylinders are located around the axial center line of said engine, parallel to and equidistant from said center line, a cylinder head of annular form in which combustion chambers are formed and on which valves and valve actuating mechanisms and a rotary, circular cam disc are mounted, a wobble plate, on one face of which is formed a mounting plate for a thrust type ball bearing, pistons operating within said cylinders and attached, by means of a connecting link, to a wobble plate, said connecting links being of the conventional gudgeon pin attachment type at the piston end while having, at the opposite end a spherical form, said spherical form being retained in a pivotal manner within a female spherical enclosure formed between a pair of lugs, one of which is formed integrally on the face of said wobble plate, the other said lug being detachable from and fastened to said wobble plate by screws, a swash plate with a means of varying the angle of axial inclination of said swash plate, a thrust bearing interposed between said swash plate and said wobble plate whereby oscillating motion of said wobble plate causes rotary motion of said swash plate in order to accomodate said oscillatory motion of said wobble plate, a carrier plate with a means of supporting said swash plate on a mounting on a fixed projection in such a manner as to allow said swash plate to be rotated in an axial direction about a swivel bearing inserted into a cavity on said carrier plate projection, a sliding link attached to a swivel mounting on said swash plate at the opposite side of said carrier plate to said carrier plate projection and passing through a spherical bearing mounted within a space in said carrier plate face, a linkage comprising a slotted bar and pivots whereby a force applied to said linkage by a hydraulic piston causes said swash plate to be so rotated about said fixed carrier plate projection as to change the angle of axial inclination of said swash plate, said carrier plate being carried in a rotary manner by said swash plate by the transferring of rotary forces through said mounting connections of said swash plate on to said carrier plate, a gear form on the peripheral face of said carrier plate whereby the rotary motion of said carrier plate may be transferred through a meshing gear to an output shaft, whereby the action of said pistons, when driven along said cylinders by means of combustion and expansion of gases, causes said wobble plate to oscillate and thereby generate reciprocating motion in said piston, said reciprocating motion causing a four stroke cycle of an internal combustion nature to occur, the power or combustion stroke of said cycle being the driving force causing said wobble plate to oscillate sequentially in response to said power or combustion strokes, said piston connecting links causing that side of said wobble plate to react against said swash plate through said thrust bearing said swash plate being forced to rotate around the said thrust bearing to allow said oscillations and thereby translate said piston reciprocating motion into swash plate rotary motion, said swash plate axial angle of inclination being controlled by said angle changing linkage similarly controlling and, by means of motion of said angle changing linkage, being changed by an operator causing said angle changing linkage to be moved, thereby causes a change in the distance from one extreme point of wobble plate oscillation to the opposite extreme point of wobble plate oscillation, said extreme points being at opposing sides of said swash plate, thereby similarly causing the distance travelled by said pistons to be changed in such a manner as to cause the stroke of said pistons to be changed whereby the proximity of said pistons to said combustion chambers does not vary with said change of stroke, that point of said stroke being determined by the height of said fixed carrier plate projection point around which said swash plate rotates, a shaft projecting from the center of said carrier plate passing through openings in the centers of said swash plate and said wobble plate and said cylinder block, thereby passing to the cylinder head end of said engine where said shaft causes to be driven a valve actuating mechanism comprising a suitable speed reducing means, a disc, on the face of said disc being formed cam shapes in such a manner that they are caused, during rotary motion of said disc in response to said driving mechanism, to pass over rollers said rollers being mounted on a pivotal mechanism in such a manner as to be forced against stems of valves in response to being moved by said cam shapes and thereby causes said valves to be opened against springs and permit the passage of inlet and exhaust gases to and from said combustion chambers in such a sequence as to generate said four stroke cycle of operation as said gases are ignited by a spark plug energized by electrical means from a distributing rotor mechanism driven by said shaft mechanism by which said cam bearing disc is driven.

2. A variable stroke internal combustion engine as described in claim 1, in which the output of said rotary motion is achieved by hydrostatic means comprising a second swash plate mounted on said carrier plate at the opposite side face of said carrier plate to said engine swash plate, and connected to the opposite end of said engine swash plate axial angle adjusting linkage causing said change in axial angle of inclination, said second swash plate being mounted pivotally on an axis perpendicular to said engine's axial center line, a second thrust bearing, a second wobble plate, said second wobble plate having a female spherical cup supported against a fixed, male spherical form, a series of hydraulic pistons operating within cylinders in such a manner as to cause, during oscillation of said second wobble plate caused by rotation of said second swash plate within said carrier plate, said pistons to move reciprocally within said cylinders, ports so arranged whereby said reciprocal motion of said pistons causes hydraulic fluid to be pumped by said pistons to a hydraulic motor of conventional form in such a manner that a change of the axial angle of inclination of said second swash plate causes a change in the volume of said hydraulic fluid pumped per revolution of said second swash plate thereupon causing a change in the ratio of revolutions of said hydraulic motor to said revolutions of said second swash plate.

3. A variable stroke internal combustion engine as described in claim 1, in which a disc bearing lobes of cam form on one face is rotated by means of a gear mechanism actuated by said projecting carrier plate shaft, rollers mounted on eccentric, adjustable, bushings, a spring mounted support by yoke form, said rollers being supported on said movable yoke in such a manner that they bear against the face of said cam disc and, on the opposite side, against the stems of said inlet and exhaust valves, and wherein adjustment of the clearance between said rollers and the flat section, or dwell, of said cam disc may be adjusted by turning said eccentric mounted bushing, said bushing being capable of being locked in any position by means of screws whereupon rotation of said cam disc causes said rollers to move when said cam forms make contact in motion with said rollers causing said rollers to act against said valve stems and cause said valves to be opened and, sequentially, closed as said rollers follow the form of said cam forms, against which they are held by the forces of said valve springs and said yoke mechanism springs, whereupon said gas inlet passages and said gas exhaust passages are opened by the action of said valve motion to permit in timed sequence arranged by the spacing of said cam forms around the face of said disc, passage of said gases between said combustion chambers and said gas manifolds in such a manner as to permit said engine cycle to operate.

4. A variable stroke internal combustion engine as described in claim 1, wherein the cylinder head is of an annular cross section within which are formed combustion chambers, valve ports, threaded spark plug orifices, coolant passage, and, through the center of said cylinder head is an opening to allow said carrier plate projecting shaft to pass and which has, formed around its outer periphery, exhaust gas manifold connections and around its inner periphery inlet gas manifold connections, and which carries supports for bearings within which bearings said cam disc and said cam disc drive shaft and speed reducing mechanisms may be carried, and which has mounted on said cylinder head platforms for the support of said valve actuating, adjusting and spring loading mechanisms.

* * * * *